United States Patent [19]

Dalrymple et al.

[11] 4,453,770

[45] Jun. 12, 1984

[54] MINING METHOD AND SYSTEM

[75] Inventors: Thomas H. Dalrymple; Hal I. Dunham, both of Marion, Ohio

[73] Assignee: Dresser Industries, Inc., Dallas, Tex.

[21] Appl. No.: 321,863

[22] Filed: Nov. 16, 1981

[51] Int. Cl.[3] ..... E21C 41/00

[52] U.S. Cl. ..... 299/7; 299/18; 299/19

[58] Field of Search ..... 299/7, 18, 19; 414/133; 405/29, 258

[56] References Cited

U.S. PATENT DOCUMENTS

| | | | |
|---|---|---|---|
| 4,135,762 | 1/1979 | Biancale | 299/13 |
| 4,139,087 | 2/1979 | Westhoff et al. | 198/309 |
| 4,150,852 | 4/1979 | McCoy | 299/18 |
| 4,183,586 | 1/1980 | Owen et al. | 299/43 |
| 4,214,386 | 7/1980 | Franke | 37/190 |
| 4,234,073 | 11/1980 | Satterwhite | 198/304 |
| 4,235,562 | 11/1980 | Ribas | 299/19 |
| 4,290,651 | 9/1981 | Files et al. | 299/7 |
| 4,345,680 | 8/1982 | Kay | 198/311 |

*Primary Examiner*—Stephen J. Novosad
*Assistant Examiner*—William P. Neuder
*Attorney, Agent, or Firm*—J. M. Lorenzen; John N. Hazelwood

[57] ABSTRACT

An improved system and method for relocating a selected layer of overburden, such as a layer of unconsolidated soil, in a strip mining operation are provided. The system employs an excavator, an intermediate belt wagon with at least two slewable conveyors, and a cross-pit conveyor having a long cantilevered conveyor pivotably supported on a mobile base; with all of said equipment being preferably based on the highwall side of the pit. According to the method, the area to be stripped is divided first into a series of large rectangles aligned parallel to the pit, with each rectangle being further divided into a series of narrow strips also parallel to the pit. The area is then progressively stripped beginning with the nearest strip of a first rectangle and proceeding with the next adjacent strip until the first rectangle is completed and then proceeding in like manner with each successive rectangle. The excavated material is transferred via the belt wagon and cross-pit conveyor directly across the pit and redistributed there in slightly curved windrows which simulate the pattern according to which it was excavated.

5 Claims, 9 Drawing Figures

MINING METHOD AND SYSTEM

The invention relates to the general field of surface mining and, more particularly, to an improved system for and method of relocating a topsoil or other selected layer of overburden in a strip mining operation to facilitate modern reclamation practices.

In a typical strip mining operation overburden which covers the mineral-bearing layer is removed along a long narrow strip or pit to facilitate mining the mineral. As the overall mining operation progresses overburden is excavated along one side of the pit, hereinafter called the highwall side, and deposited in spoil piles in a previously mined out area on the opposite side of the pit, hereinafter called the reclamation side.

Because the material above the mineral-bearing seam is not homogenous throughout its depth, modern reclamation laws require that certain layers, such as that comprising topsoil and rooting media, be handled separately and replaced in their same respective geologic positions in the reclamation area. Because of the length of the typical strip mine, the separate handling of the selected soil layer has complicated mine schemes and substantially increased their operating costs. However, these additional burdens can be substantially reduced by employing a cross-pit conveyor to transfer the selected soil directly over and across the pit beyond the working spoil piles to the desired refil area. A cross-pit conveyor of the type described hereinafter permits such direct transfer without interfering with the conventional operation of the overburden excavator and the mineral mining and transporting equipment. Once transferred to the refill area, the soil material must be distributed to form a uniform layer over the other overburden materials; a further step which adds to the cost of the mining operation.

The object of the present invention is to provide a system for relocating a selected layer of overburden, in a strip mining operation, which is simple, efficient, and does not interfere with the otherwise conventional handling of other overburden and mining of the mineral-bearing material.

It is another object of the invention to provide a method of excavating the selected layer, transferring it across the pit, and distributing it in the refill area in a manner minimizing the amount of leveling and grading necessary to complete the reclamation process.

SUMMARY OF THE INVENTION

The soil-handling system according to the invention employs an excavator, a mobile conveyor belt wagon and a cross-pit conveyor. The cross-pit conveyor comprises a long conveyor supported in a cantilevered manner by a rotatable frame mounted on a mobile base. The excavator is provided to dig the selected soil material and feed it to the cross-pit conveyor. The mobile conveyor or belt wagon is used between the excavator and the cross-pit conveyor to allow the excavator to move independently of the cross-pit conveyor within certain limits. Preferably the base of the cross-pit conveyor is located on the highwall side of the pit and can advance therealong as the mining scheme progresses. The long conveyor is pivotable about the base in the horizontal plane and can distribute the excavated soil material in slightly curved windrows on the reclamation area.

The improved method according to the invention begins by dividing the undisturbed soil layer into a series of rectangles aligned end-to-end parallel with the pit. Each of these large rectangles is further divided into a series of narrower strips extending parallel to the pit. The soil material is first removed progressively along the nearest (to the pit) strip of a first rectangle. The material is fed to the cross-pit conveyor and conveyed across the pit. By a simple slow pivoting of the cross-pit conveyor the soil material is discharged in a narrow curved windrow which corresponds substantially in dimensions to the excavated strip. When the innermost strip has been relocated, the equipment is shifted perpendicular to and away from the pit and the next strip of soil in the first rectangle is excavated, conveyed and deposited in a corresponding windrow in the reclamation area. These steps are repeated until the first rectangle has been completely relocated. Then the equipment is moved to the starting position for the next rectangle.

As a result of practicing this method, the selected soil layer is separately excavated, transferred directly and economically across the pit, then evenly distributed over a corresponding area in the reclamation side. Only a minimal amount of grading need be done to complete the reclamation work.

The mining system and method are hereinafter described in more detail with reference to the accompanying drawings, which form a part of this specification, and of which:

Figure 6:
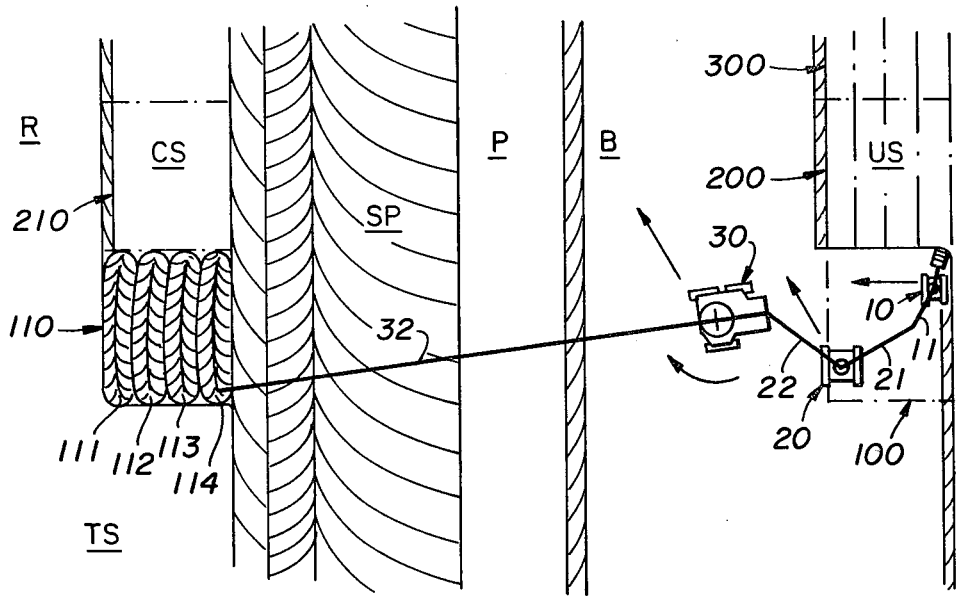
Figure 7:
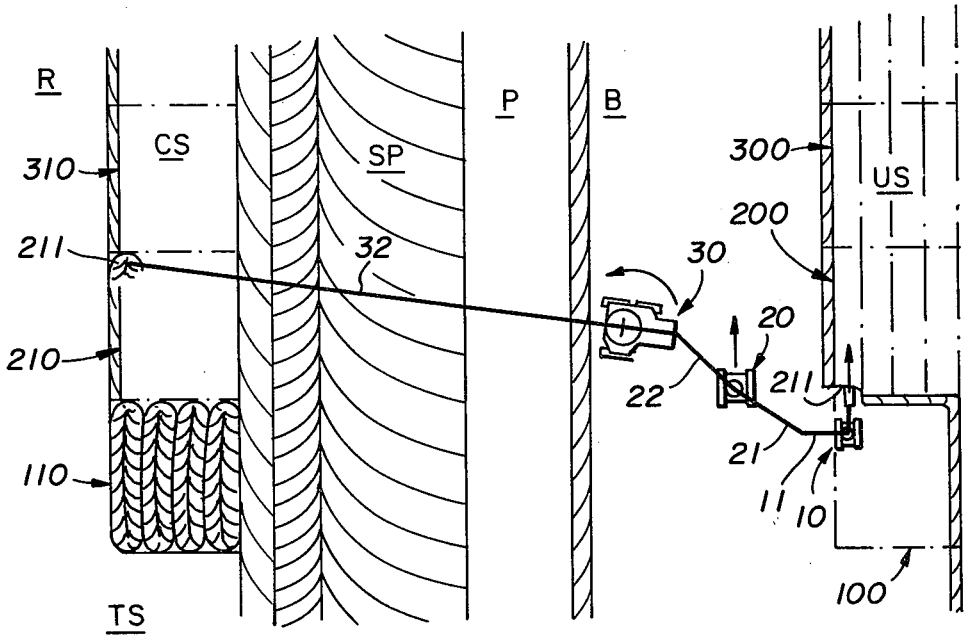
Figure 8:
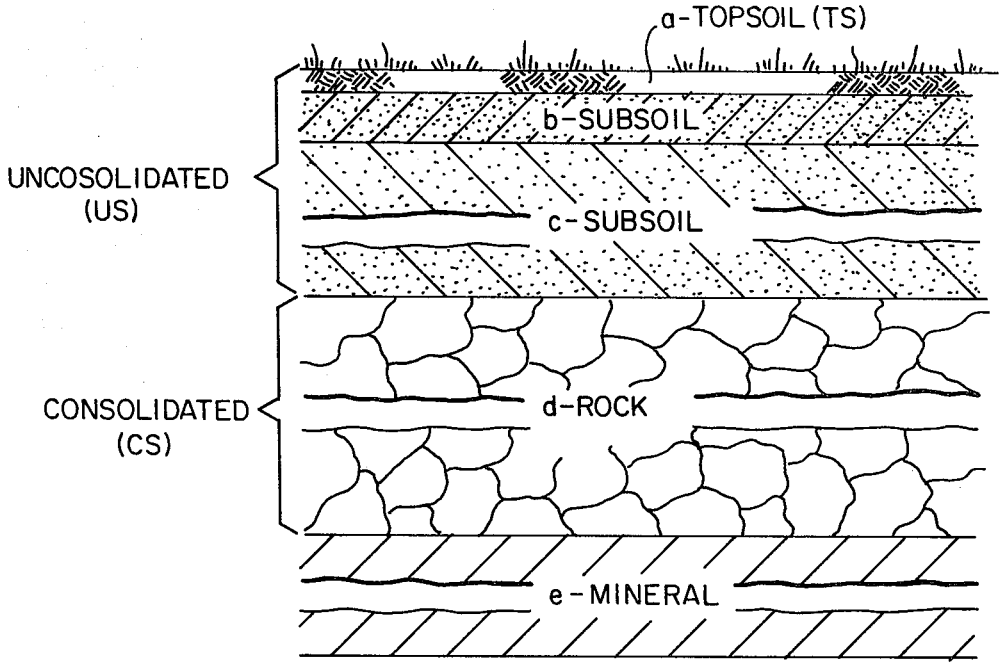
Figure 9:
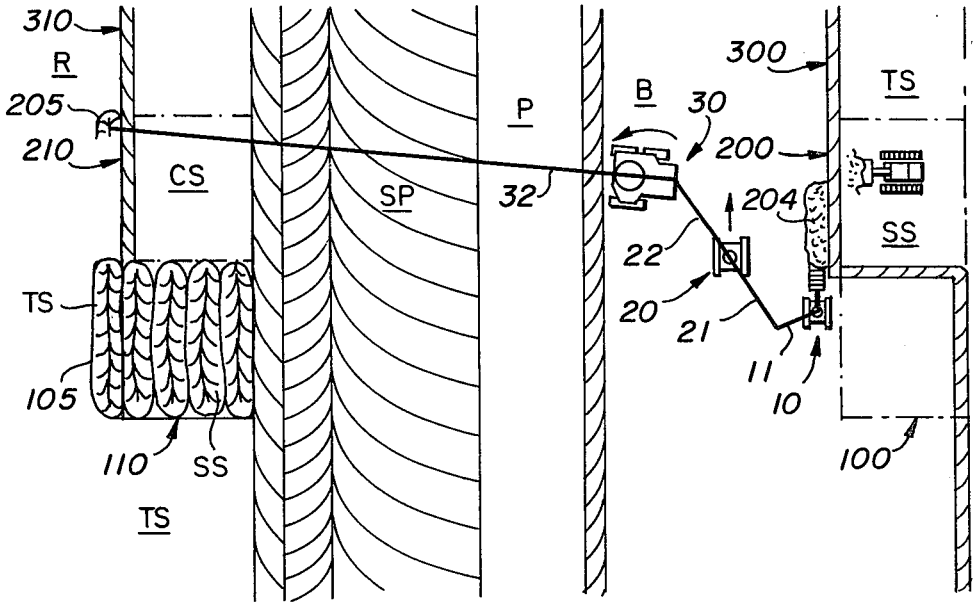

FIGS. 3–7 are a series of schematic plan views showing sequentially the respective steps comprising the method of relocating a selected soil layer according to the invention; and FIG. 8 is a schematic illustration of a cross-section of the overburden materials typically overlaying a mineral seam; and FIG. 9 is a schematic plan view showing the method of the invention modified slightly to separately relocate a topsoil and next lower layer of soil sequentially.

The reader's attention is directed initially to FIG. 9 for background regarding the typical make-up and arrangement of geologic materials overlaying a seam e of mineral M to be mined. The term mineral is meant herein to include coal, lignite, various ores, or any other prize material that is surface mined.

Immediately above the mineral seam is a layer d of consolidated overburden CS such as rock. In mining terminology, consolidated overburden is distinguished by the need for blasting, ripping or some other manner of breaking it up before it can be dug. Above the consolidated material are one or more layers of unconsolidated material US, such as a layer c of compacted subsoil followed by a next higher layer b of looser subsoil. Sub-soil b usually comprises rooting media for trees, shrubs and the like. Finally, on top is a surface layer a of loose and fertile topsoil TS. For the singular purpose of illustrating typical relative thicknesses, the thickness of the layers in FIG. 9 may be in the order of one foot for layer a, three feet for layer b, twenty-five feet for layer c, and fifty to one hundred or more feet for layer d.

Although not necessarily limited thereto, the present system and method are particularly suited for the excavation and relocation of layers a, b and c comprising the unconsolidated overburden US. In the discussion which follows with reference to FIGS. 1–7, the system and method are first explained in regard to excavating any individual selected layer of unconsolidated overburden. However "any selected layer" is intended to mean any single geologic layer or combination of adjacent layers which can be permissably intermingled according to reclamation requirements. Later, with reference to FIG. 9, the method is modified slightly to handle two layers separately but concurrently during a single pass of the equipment along the pit. It will, of course, become apparent that the system and method could be employed to excavate and relocate more than one selected layer by making multiple passes along the pit.

Figure 1:
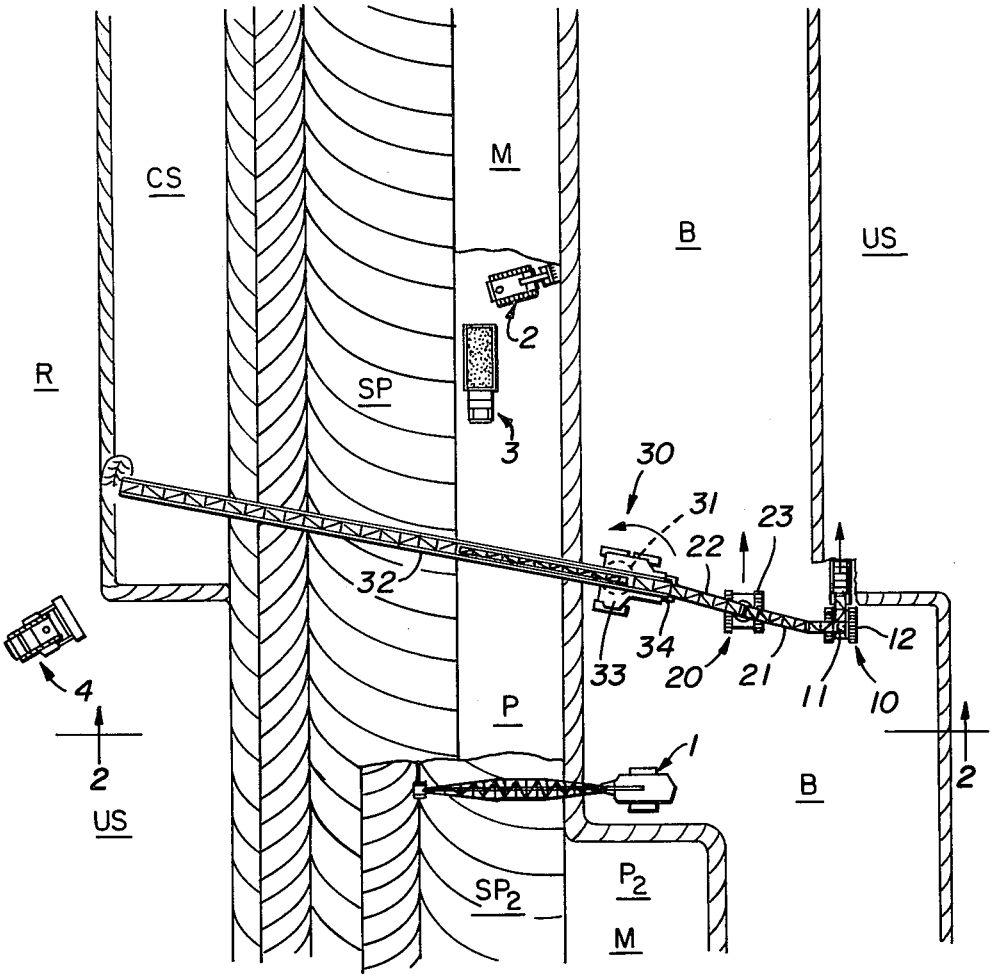
FIG. 1 is a plan view showing a general arrangement and type of equipment employed in the system and method of the present invention as applied in a typical strip mining operation.
Figure 2:
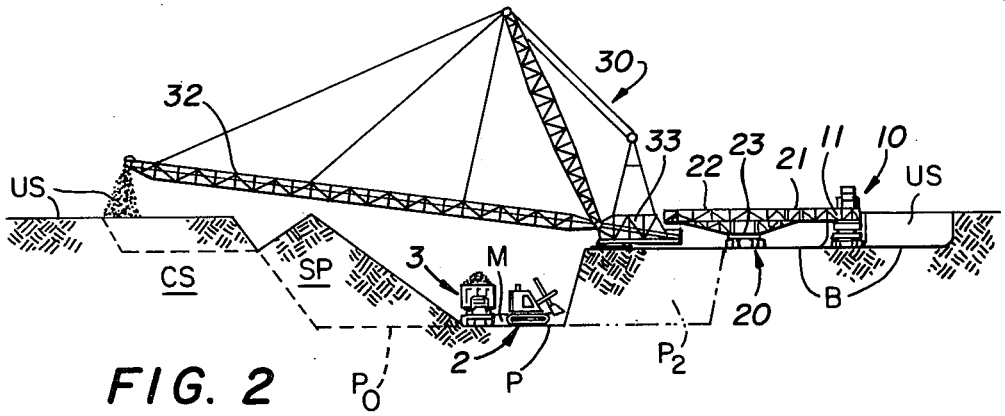
FIG. 2 is a side elevation of the mining operation of FIG. 1 further depicting the arrangement of the equipment employed therein.

With the foregoing background in mind, FIGS. 1 and 2 show a typical strip mining operation which has already been started. A long pit P has been established by removing the unconsolidated and consolidated overburden from above the mineral-bearing seam M and depositing it on the reclamation side R. Additional soil material has been removed from on top the consolidated overburden to form the bench area B on the highwall side. A dragline 1 standing on the bench is uncovering the next pit $P_2$ by removing the remaining overburden and depositing it across the first pit in spoil piles SP in the area of previously mined out pit $P_0$. At the same time a mining shovel 2 is digging up mineral-bearing material along the floor of the pit P and loading it into a truck 3 for haulage to a processing facility. One or more bulldozers 4 is operating in the reclamation area to level out the spoil piles CS and for final grading of the relocated soils TS.

As described thus far the strip mining operation shown in FIGS. 1 and 2 is quite typical, although other equipment can be substituted in the various operations mentioned.

However, the unconsolidated upper soil layer US is being relocated by the system and method according to the invention hereinafter claimed. The system involves the use of an excavator 10, an articulated mobile conveyor or belt wagon 20, and a cross-pit conveyor 30, all operationally located on the bench B on the highwall side of the pit. The excavator is represented here by a traveling bucket wheel excavator, although other types of equipment such as a power shovel, a hydraulic excavator, a front end loader, or the like could be used. At the least the excavator 10 includes means 11 for discharging the excavated soil onto an associated end of the mobile conveyor 20. The mobile conveyor has two conveyor sections 21 and 22, each pivotable about the central traveling base 23. The conveyor 21 can be positioned to receive material from the excavator and conveyor 22 positioned to discharge the soil material onto the cross-pit conveyor. Because of its articulation, the mobile belt wagon allows the excavator 10 to move independently of the cross-pit conveyor 30.

The cross-pit conveyor 30 is supported on an ambulatory, or otherwise moveable base 31, and has an upper frame 33 and long cantilevered conveyor 32 which can pivot horizontally about the base. Preferably, the cross-pit conveyor also has hoisting capability to raise and lower the discharge end of the long conveyor 32. A hopper 34 located at the rear or receiving end of the cross-pit conveyor receives the excavated soil material from the conveyor 22 of the belt wagon. A more detailed description of a cross-pit conveyor suited for this system can be found in U.S. Pat. No. 4,290,651 of in co-pending application Ser. No. 321,862. Because of its long radius, the cross-pit conveyor can distribute its payload at the discharge end in a nearly linear path by a limited pivotal motion. At the same time the rear or tail end of the cross-pit conveyor will move a much shorter distance. The cross-pit conveyor is long enough to carry the soil across the pit P and beyond the unleveled spoil pile SP.

In its simplest sense the soil handling operation consists of excavating the undisturbed soil US with the excavator 10, feeding it onto the intermediate belt wagon 20 which is turn feeds it to the tail end of the cross-pit conveyor 30, transporting it across the pit P and active spoil piles SP on the main conveyor 32 and distributively depositing it in the reclamation area with some pivotal motion of the cross-pit conveyor.

However, the system of equipment just described permits a patterned method of relocating the soil layer as will now be described with reference to FIGS. 3–7. The first step in this method is to divide the undisturbed soil area into a series of relatively large rectangles 100, 200, 300, etc. which are aligned end-to-end parallel with the pit P. Next, each of these larger rectangles, such as the one indicated by reference numeral 100, is further divided into a series of narrower strips, as indicated by 101, 102, 103, and 104, which extend the length of the rectangle and parallel to the pit P.

Figure 3:
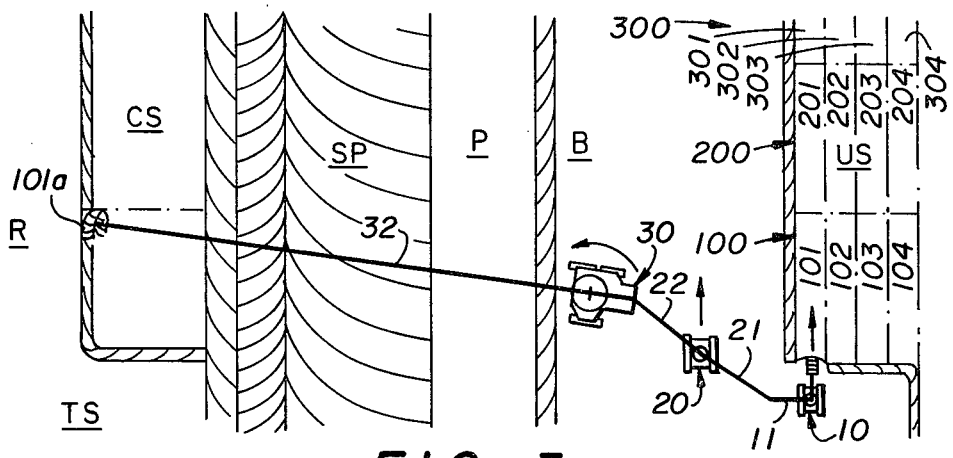
Figure 4:
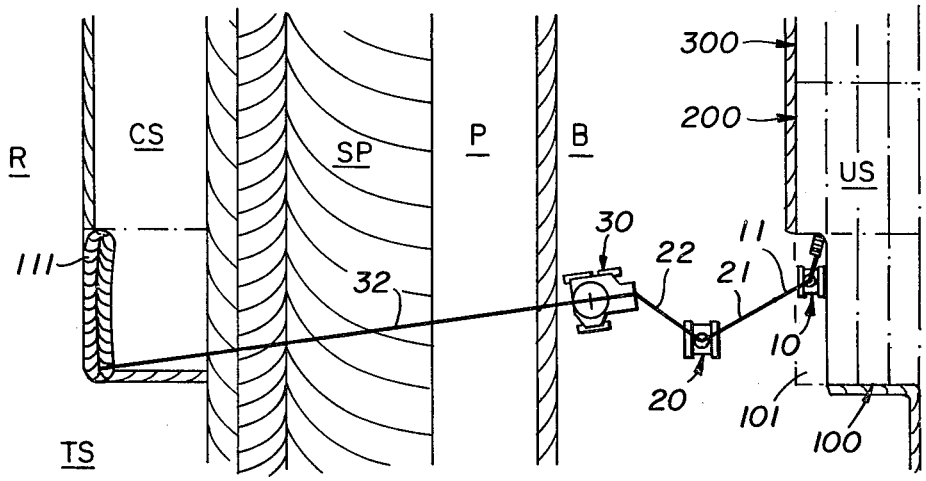
Figure 5:
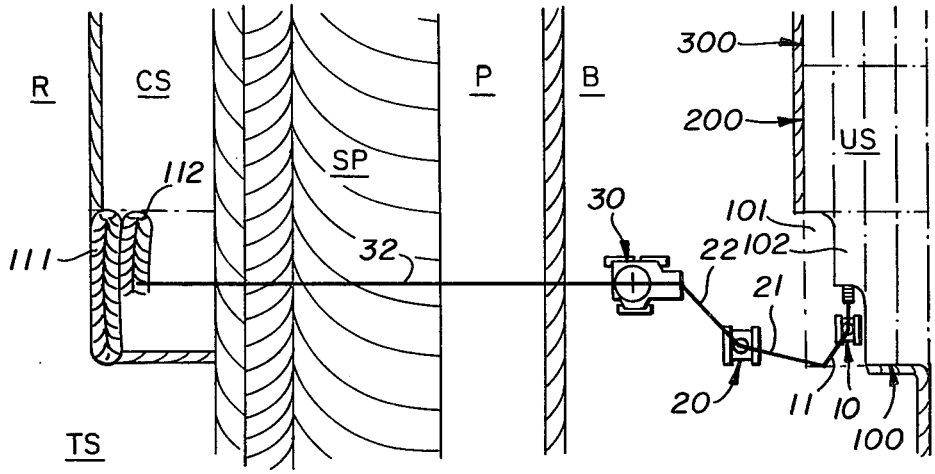

The equipment is positioned as shown in FIG. 3 such that the excavator 10 begins digging the soil progressively along the strip 101 nearest the pit in the first rectangle 100. The excavated material is conveyed via the mobile conveyor 20 and cross-pit conveyor 30 to a position 101*a* in the reclamation area. As the digging of strip 101 progresses, the excavator moves in the direction of the arrow in FIG. 3 and the cross-pit conveyor pivots slowly counterclockwise. Thus, as shown in FIG. 4, when strip 101 has been totally removed and transferred, the soil material from it will be distributed as a slightly curved strip or window 111 which corresponds generally to the dimensions of strip 101.

After the soil from strip 101 has been relocated to windrow 111, the excavator 10 is repositioned to begin digging strip 102, and the cross-pit conveyor is backed away from the pit the width of one strip. Strip 102 is now excavated progressively, transferred across the pit and distributed as strip 112 on the reclamation side.

The foregoing steps are repeated to excavate sequentially the remaining strips 103 and 104 in the first rectangle 100 and deposit the material from them in corresponding windrows 113 and 114. Thus, when all of rectangle 100 has been relocated, it will be distributed over a corresponding rectangular area 110 on the reclamation side as shown in FIG. 6.

The equipment is now moved as indicated by the arrows in FIG. 6 to begin stripping the soil from rectangular area 200 and relocating it in reclamation area 210. This involves moving the excavator toward the pit to the beginning of strip 201, and moving the cross-pit conveyor diagonally to a position nearer the pit and opposite rectangle 200. In all the foregoing movements of equipment, the intermediate belt wagon 20 is positioned as necessary to provide continuity between the tail end of the excavator and the tail end of the cross-pit conveyor. Once relocated, the equipment is operated to relocate the soil material of the next rectangle 200 such as shown in FIG. 7.

The method just described provides an orderly progression of soil transfer according to a simple pattern with a minimal amount of equipment movement. The method results in an even distribution of the excavated soil over an area in the reclamation zone corresponding to the area from which it was removed, and consequently greatly reduces the amount of final grading that needs to be done before reseeding.

Moreover, the system according to the invention does not interfere with the other strip mining operations being carried on in the well established conventional manner, and transfers the selected soil in the most direct and economical manner known.

Referring now to FIG. 9, the aforedescribed method can be modified slightly to separately relocate more than one layer of unconsolidated overburden during a single pass along the highwall. In the example shown, the relatively thin upper layer of topsoil TS is first bulldozed off the object rectangle 200 along the edge nearest the pit. The elongated pile 204 of topsoil material thus formed is picked up by the excavator 10 and conveyed across the pit to beyond the corresponding reclamation rectangle 210 as shown at 205. The next layer of subsoil SS from rectangle 200 is then stripped and relocated to rectangle 210 following the steps described in connection with FIGS. 3–7.

After the two soils have been relocated, such as shown by piles 105 and 110 from previous rectangle 100, the subsoil materials are leveled first. Then the topsoil material 105 or is spread across the top of the area to essentially restore the materials in their natural order.

The embodiments of the invention in which an exclusive property or privilege is claimed are defined as follows:

1. A method of relocating a selected layer of soil in a strip mining operation in which the remaining overburden above a mineral seam is separately removed along the highwall side of an elongated pit and deposited in a previously mined out area adjacent to the opposite side of the pit, comprising the steps of:

(a) sectioning an area of said selected layer into a series of rectangles arranged end-to-end parallel to the pit;

(b) further dividing each of said rectangles into a series of side-by-side strips, each extending parallel to the pit and the length of the rectangle;

(c) excavating the selected layer starting at one end of the nearest strip in a first rectangle and progressing along said strip to its opposite end;

(d) transferring the loosened soil over and across the pit and distributing it on said separately relocated overburden material in a strip substantially corresponding to the strip from which said soil came;

(e) repeating steps (c) and (d) to excavate and transfer the soil from the next adjacent strip in the first rectangle and deposit it in a corresponding strip adjacent the first deposited strip;

(f) repeating step (e) until all of the soil from the first rectangle has been removed and relocated to a corresponding rectangle on the reclamation side;

(g) repeating steps (c) through (f) to excavate and transfer the soil from the next adjacent rectangular area; and (h) repeating step (g) until all of the soil from the row of rectangles has been transferred over and across the pit and deposited on the relocated overburden in a pattern of aligned rectangles corresponding to the originally surveyed rectangles on the highwall side.

2. A method of relocating a soil layer in a strip mining operation in which the overburden underlaying said soil layer and overlaying the targeted mineral seam is separately removed along the highwall side of an elongated pit and deposited in a previously mined out area on the opposite side of the pit, comprising the steps of:

(a) dividing an area of the soil layer into a series of rectangles aligned end-to-end parallel to the pit;

(b) further dividing each of said rectangles into a series of side-by-side strips extending parallel to the pit and end-to-end of the rectangle;

(c) providing an excavator on the highwall bench and excavating the soil layer from each rectangular area starting with the strip nearest the pit and proceeding end-to-end thereof and then in similar fashion strip-by-strip across the width of the rectangle;

(d) providing a cantilevered cross-pit conveyor on the highwall and concurrently with step (c) conveying the excavated soil across the pit and depositing it on the separately relocated overburden in a series of side-by-side elongated piles corresponding to the strips from which said soil layer was excavated; and (e) proceeding to the next rectangle and repeating steps (c) and (d).

3. A method as recited in claim 2, wherein step (d) comprises:

providing a long cantilevered cross-pit conveyor pivotally mounted on a base positioned on the highwall and concurrently with step (c) conveying the excavated soil across the pit and by pivoting the cross-pit conveyor distributing said soil in a series of side-by-side elongated but slightly curved windrows corresponding substantially to the strips from which it was excavated.

4. A method of separately excavating and relocating a layer of topsoil and a layer of sub-soil across an elongated pit in a strip mining operation, comprising the steps of:

(a) dividing an undisturbed area of said layers into a series of rectangles aligned end-to-end parallel to the pit;

(b) further dividing each of said rectangles into a series of side-by-side strips extending the length of the rectangle parallel to the pit;

(c) stripping the topsoil layer off of a first of said rectangles and forming it into an elongated pile along the edge of said rectangle nearest the pit;

(d) loading said stripped topsoil onto a cross-pit conveyor, conveying it across the pit and depositing it in a corresponding elongated pile beyond the far side of a rectangular area on the other side of the pit which conforms to said first rectangle;

(e) excavating the sub-soil layer of said first rectangle starting with the strip nearest the pit and proceeding strip-by-strip across the width of said first rectangle;

(f) concurrently with step (e) transferring the excavated sub-soil across the pit using the cross pit conveyor and depositing it in a series of side-by-side elongated piles corresponding to the strips from which it was excavated to cover the corresponding rectangular area on the other side of the pit; and (g) repeating steps (c) through (f) for each successive rectangle on the highwall side until all of the desired topsoil and sub-soil has been relocated to the other side of the pit.

5. A method as recited in claim 4 including the further steps of:

(a) leveling the piles of relocated sub-soil over each of said rectangles; and (b) spreading said pile of relocated topsoil across the corresponding rectangle of leveled sub-soil.

* * * * *